US007902696B2

(12) United States Patent
Tsutada et al.

(10) Patent No.: US 7,902,696 B2
(45) Date of Patent: Mar. 8, 2011

(54) CONTROLLED SWITCHING DEVICE

(75) Inventors: Hiroyuki Tsutada, Tokyo (JP); Takashi Hirai, Tokyo (JP); Haruhiko Kohyama, Tokyo (JP); Kenji Kamei, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 539 days.

(21) Appl. No.: 11/947,371

(22) Filed: Nov. 29, 2007

(65) Prior Publication Data

US 2008/0269952 A1 Oct. 30, 2008

(30) Foreign Application Priority Data

Apr. 27, 2007 (JP) ..... 2007-119429

(51) Int. Cl.
*H01H 47/20* (2006.01)

(52) U.S. Cl. ..... 307/129; 361/185

(58) Field of Classification Search ..... 307/129, 307/73; 361/76, 77, 185, 244; 200/237, 200/308

See application file for complete search history.

(56) References Cited

U.S. PATENT DOCUMENTS

| | | | | |
|---|---|---|---|---|
| 5,629,869 | A | 5/1997 | Johnson et al. | |
| 5,636,134 | A | 6/1997 | Johnson et al. | |
| 5,638,296 | A | 6/1997 | Johnson et al. | |
| 6,433,980 | B1 * | 8/2002 | Tsutada et al. | 361/83 |
| 6,646,361 | B2 * | 11/2003 | Martin | 307/118 |
| 7,095,139 | B2 * | 8/2006 | Tsutada et al. | 307/129 |
| 2005/0013080 | A1 | 1/2005 | Pilz et al. | |

FOREIGN PATENT DOCUMENTS

JP 2003-168335 6/2003

OTHER PUBLICATIONS

K. Froehlich, et al., "Controlled Closing on Shunt Reactor Compensated Transmission Lines", IEEE Transactions on Power Delivery, vol. 12, No. 2, Apr. 1997, pp. 734-746.

* cited by examiner

*Primary Examiner* — Albert W Paladini
(74) *Attorney, Agent, or Firm* — Oblon, Spivak, McClelland, Maier & Neustadt, L.L.P.

(57) ABSTRACT

A target-closing phase-map generating section generates in advance a target closing phase map in consideration of a pre-arc characteristic and variations of a mechanical action of a breaker, and amplitude fluctuations of the load voltage. A target-closing time calculating section calculates a target closing time string from frequencies and phases of the power source voltage and the load voltage, respectively, of the breaker referring to the target closing phase map. A closing control section, when a close command 11 is inputted, controls the timing of outputting a closing control signal based on a predicted closing time and the target closing time string.

12 Claims, 4 Drawing Sheets

CONTROLLED SWITCHING DEVICE

BACKGROUND OF THE INVENTION

1. Field of the Invention

The present invention relates to a controlled switching device controlling opening and closing timing of a power switchgear such as a circuit breaker, and more particularly to a controlled switching device, which suppresses an overvoltage generated in time of making of a transmission line.

2. Description of the Related Art

In a conventional controlled switching device, the device finds frequencies, phases, and amplitudes from a power source voltage of a breaker and from measured waveforms of a load voltage for functional approximation; synthesizes an interpole voltage from the current time on using these approximation functions; executes a signal conversion based on a pre-arc characteristic of the breaker and a signal conversion based on variations of a mechanical action of the breaker; and determines a target closing time thereof (for example, see Patent Document 1). Then, the breaker is closed at this target closing time, thus suppressing the overvoltage generated at the time of making of a transmission line.

Patent Document 1: JP-A2003-168335

In general, sometimes a controlled switching device is used for a high-speed reclosing path in the event of a breakdown of a transmission line. In such a usage, it is required that within the limited time of about 500 milliseconds from the occurrence of a failure of the transmission line, a target closing time, at which the overvoltage is suppressed in time of making of the transmission line, and then the breaker is closed. In the above-described conventional controlled switching device, a lot of calculations have to be made to determine the target closing time during working of the device. Consequently, there has been demand for a high-performance arithmetic unit, with increased the cost of the device.

SUMMARY OF THE INVENTION

The present invention has been made to solve the above-mentioned problem, and an object of the present invention is to provide a controlled switching device able to offer a simple calculation during working of the device, and high-speed control even with an inexpensive arithmetic unit.

The controlled switching device according to the present invention includes a target-closing phase-map generating section generating a target closing phase map beforehand in consideration of a pre-arc characteristic and variations of a mechanical action of a power switchgear, and amplitude fluctuations of a load voltage; a target-closing time calculating section calculating a target closing time string from a frequency and a phase of each of power source voltages and a load voltage in the power switchgear referring to the target closing phase map; and a closing control section, when a close command is inputted to the power switchgear, controlling, based on a preset predicted closing time and the target closing time string, the timing of outputting a closing control signal for instructing the power switchgear to start its closing operation.

The controlled switching device according to the present invention is arranged such that the target-closing phase-map generating section generates in advance a target closing phase map, and the target-closing time calculating section calculates a target closing time string based on the target closing phase map, thus providing a simple calculation during working of the device, and high-speed control even with an inexpensive arithmetic unit.

DETAILED DESCRIPTION OF THE PREFERRED EMBODIMENTS

First Embodiment

Figure 1:
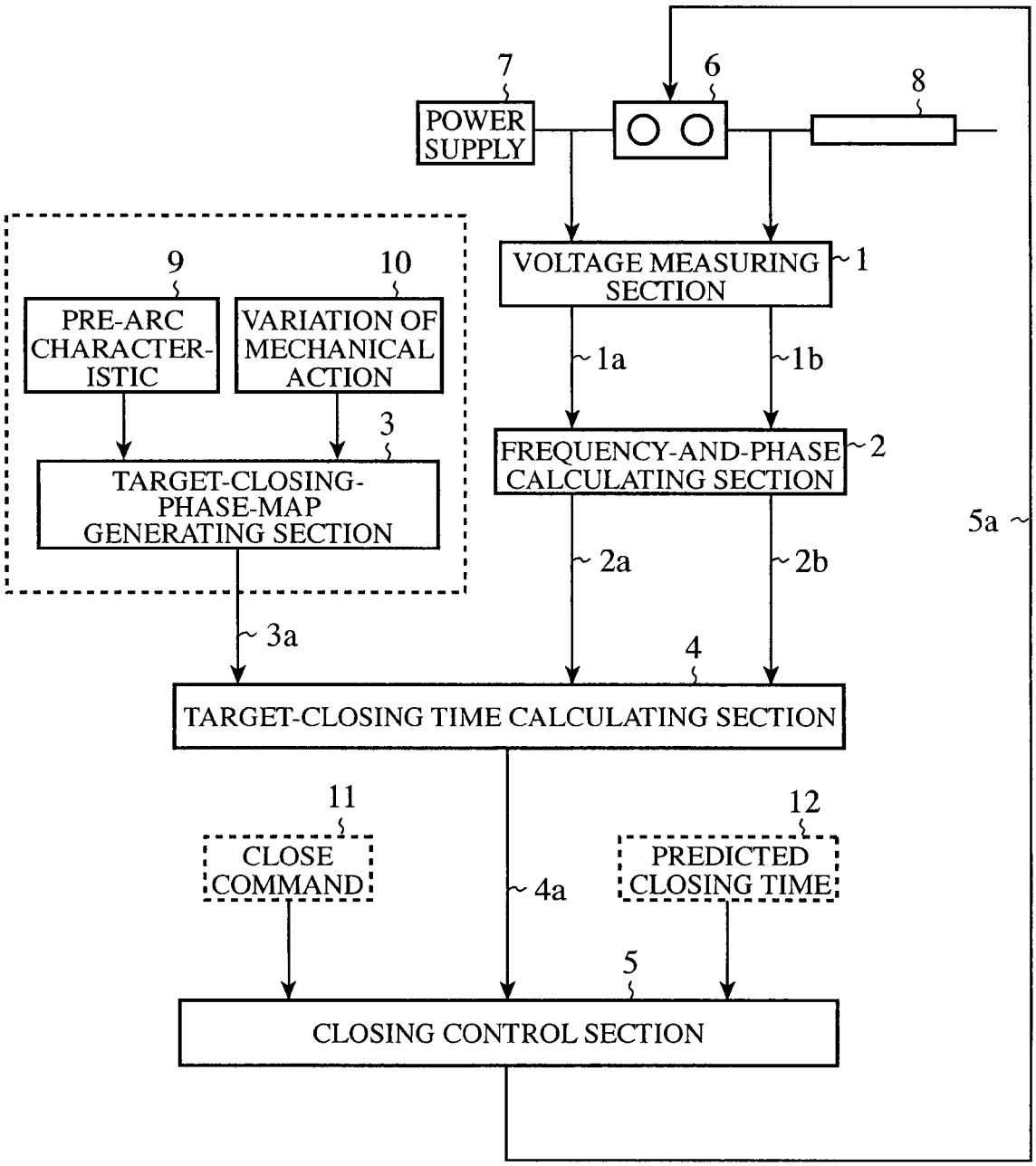
FIG. 1 is a block diagram showing a controlled switching device according to the first embodiment of the present invention.

FIG. 1 is a block diagram showing a controlled switching device according to the first embodiment of the present invention.

Referring to the figure, the controlled switching device includes a voltage measuring section 1, a frequency-phase calculating section 2, a target-closing phase-map generating section 3, a target-closing time calculating section 4, and a closing control section 5.

The voltage measuring section 1 is a section measuring a power source voltage and a load voltage of a breaker 6, which is a power switchgear, and storing these voltages for a fixed period of time. Further, the breaker 6 is a device that is provided between a power supply 7 and a transmission line 8 located on the load side, and performs making of a power from the power supply 7 to the transmission line 8.

The frequency-phase calculating section 2 is a section calculating a frequency and a phase of each of a power source voltage 1*a* and a load voltage 1*b*, measured by the voltage measuring section 1. The target-closing phase-map generating section 3 is a section previously generating a target closing phase map 3*a* in consideration of a pre-arc characteristic 9 and variations of a mechanical action 10 of the breaker 6, and amplitude fluctuations of the load voltage prior to working of the device. The target-closing time calculating section 4 is a section for calculating a target closing time string, referring to the target closing phase map 3*a*, from the frequency and the phase of each of the power source voltage and the load voltage, calculated by the frequency-phase calculating section 2. The closing control section 5 is a section, upon input of a close command 11 thereto, controls, the timing of outputting a closing control signal 5*a* for instructing the breaker 6 to start its closing operation, based on a predicted closing time 12, and the target closing time string 4*a* outputted from the target-closing time calculating section 4.

Then, the operation of the controlled switching device thus configured as above will be explained below.

The voltage measuring section 1 measures the power source voltage and the load voltage of the breaker 6, stores these voltages for a fixed period of time, and outputs these voltages to the frequency-phase calculating section 2 as the power source voltage 1*a* and the load voltage 1*b*.

The frequency-phase calculating section 2 calculates a frequency and a phase 2*a* of the power source voltage and a frequency and a phase 2*b* of the load voltage, respectively, from the power source voltage 1*a* and the load voltage 1*b* corresponding to those for a past fixed period of time, outputted from the voltage measuring section 1. To be more specific, the frequency-phase calculating section detects, and stores a plurality of certain zero-cross point times at which the obtained voltage signal changes its sign, from negative to positive, vice versa. When the voltage signal is a sine wave signal, the zero-cross point is obtained every half-cycle and therefore, the value, which is obtained by averaging a reciprocal number of the mean value in the time interval between each of the plurality of stored zero-cross point times, and by doubling the reciprocal number, may be taken as a frequency f (Hz). Concerning a frequency of the power source voltage, it is fixed to a frequency of 50 Hz or of 60 Hz according to a system condition and therefore, the value, which has been preset, is used.

Regarding the phase, letting the time, which is closest to the current time in the plurality of stored zero-cross point times, be t1 (sec) and the current time be t2 (sec), the phase is calculated from the following equations.

Where the voltage signal changes from negative to positive at the zero-cross point of the time t1, $$\text{the phase (degree)}=(t2-t1)\times f\times 360, \text{ and}$$

where the signal changes from positive to negative at the zero-cross point of the time t1, $$\text{the phase (degree)}=(t2-t1)\times f\times 360+180.$$

The above-mentioned calculations give a frequency and a phase 2*a* of the power source voltage, and a frequency and a phase 2*b* of the load voltage.

Then, the operation of generating a target closing phase map in the target-closing phase-map generating section will be explained below.

First of all, a characteristic of the breaker 6 will be taken up here. When a closing control signal 5*a* is outputted from the closing control section 5, contacts of the breaker 6 come in mechanically contact with each other after a certain mechanical operation time lapsed. A moment at which the contacts come in mechanically contact is referred to as "closing," and the time elapsed from an output of the closing control signal 5*a* to "closing" of the contacts are "closed" is referred to as "closing time." Further, it is known that the main circuit current begins to flow by a pre-discharge prior to closing. This pre-discharge is referred to as a "pre-arc," and a moment at which the main circuit current begins to flow is referred to as "making." The moment of making depends on the voltage applied between the contacts of the breaker 6, i.e., on the absolute value of the interpole voltage, which is a difference value between the power source voltage 1*a* and the load voltage 1*b*.

Figure 2:
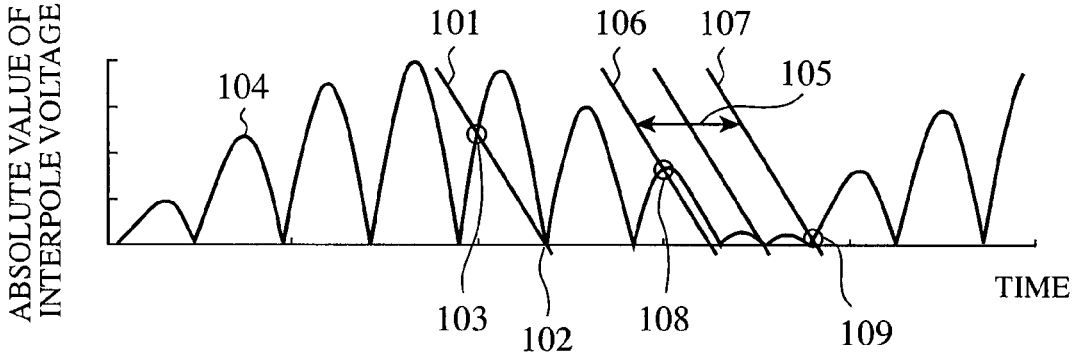
FIG. 2 is an explanatory diagram showing a transition of the absolute value of an interpole voltage with the change of times of the controlled switching device.

FIG. 2 is an explanatory diagram showing a transition of the absolute value of the interpole voltage with the change of times.

An withstand voltage line 101 shown in FIG. 2 shows a value of the withstand voltage between the contacts at a certain time in the breaker closed at the time 102, and its slant is uniquely determined according to the pre-arc characteristic of the breaker 6. When the absolute value 104 of the interpole voltage is lower than a value of the withstand voltage at a certain time, the making will not be taken place because the withstand voltage between the contacts exceeds the interpole voltage. However, at point 103 shown in FIG. 2, which is an intersection between the withstand voltage line 101 and the absolute value 104 of the interpole voltage, the withstand voltage between the contacts becomes less than the absolute value 104 of the interpole voltage, thus generating a pre-arc and giving rise to the making. Hereinafter, the intersection between the withstand voltage line 101 and the absolute value 104 of the interpole voltage is referred to as a "making point,".

In order to suppress the overvoltage generated at the time of the making, it should make the breaker 6 at a moment when the absolute value of the interpole voltage becomes minimum. Therefore, it should determine the target closing time, after consideration of the pre-arc characteristic, such that a moment when the absolute value of the interpole voltage becomes minimum is a making point, and that the closing control signal 5*a* should output so that the breaker 6 is closed at the target closing time.

However, the predicted closing time 12, which is a predicted value of the next closing time, does not necessarily coincide with the actual closing time, as the breaker 6 does entail mechanical variations in operation. In other words, the output of the closing control signal 5*a* at the time going back from the target closing time by the predicted closing time 12 results in the actual closing times being normally distributed with the actual closing time as the target closing time.

In FIG. 2, the variation range of the withstand voltage line on the occasion of the presence of the variation 105 in the closing time is shown by 106 and 107. Therefore, in the example shown in FIG. 2, the making is occurred within the range of from the point 108 to the point 109.

Further, in case of failure of the transmission line, the power source voltage 1*a* can be considered to have a rated amplitude. However, the load voltage 1*b* fluctuates its amplitude according to the conditions in failure, leading to a change of the magnitude of the interpole voltage, which is a difference value between the power source voltage 1*a* and the load voltage 1*b*.

The method of generating the target closing phase map will be explained referring to FIG. 3, in consideration of the pre-arc characteristic of the breaker, the variations of the mechanical action of the breaker, and the amplitude fluctuations of the load voltage, all having already been mentioned hereinabove.

Figure 3:
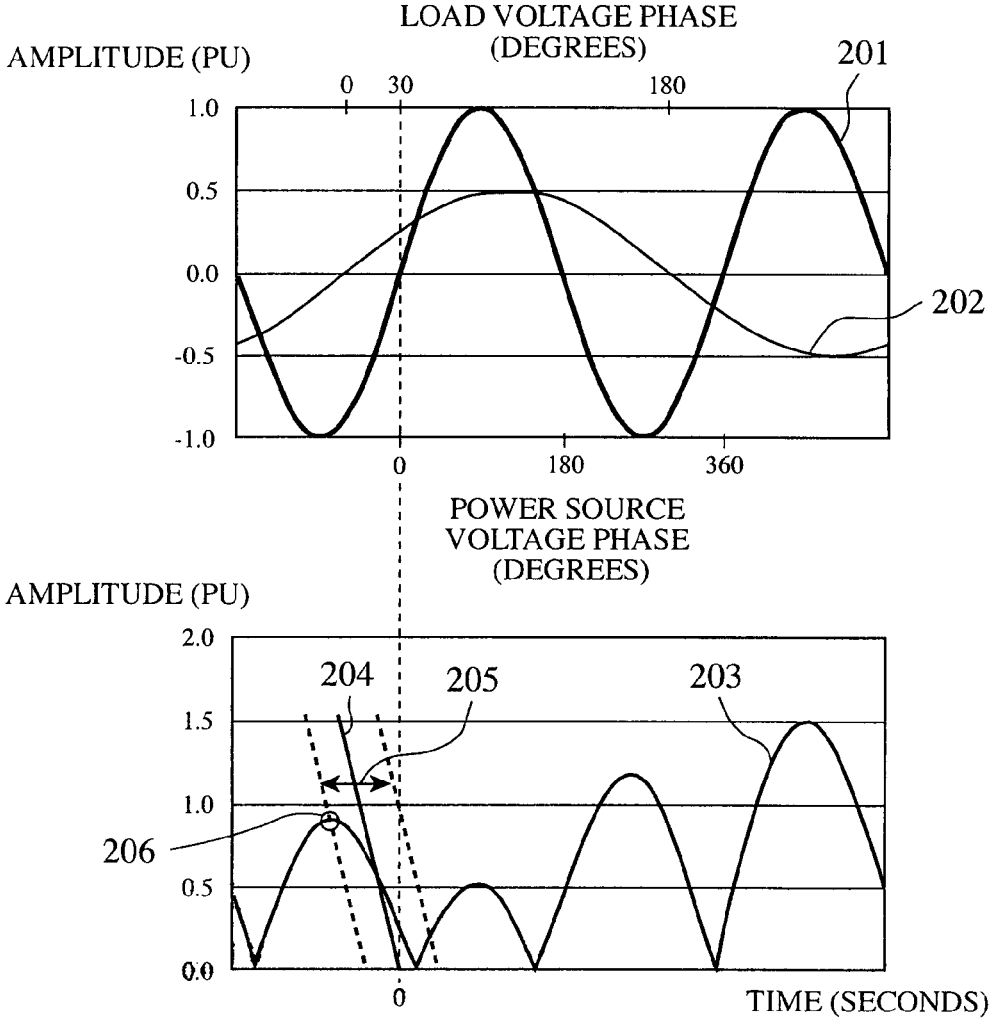
FIG. 3 is an explanatory diagram showing a power source voltage, a load voltage, and a change of the interpole voltage of the controlled switching device.

FIG. 3 is an explanatory diagram showing the power source voltage 201, the load voltage 202, and a transition of the absolute value of the interpole voltage 203.

At the first, a slant of the withstand voltage line 204 is set in advance based on the pre-arc characteristic of the breaker 6. Further, a closing time variation 205 is set beforehand based on the variations of the mechanical action of the breaker 6. An explanation will be forwarded hereinafter on condition that the frequency of the power source voltage is 60 (Hz). FIG. 3 shows a method of finding a map point of (the phase of the power source voltage, the phase of the load voltage) =(0 degree, 30 degrees) respectively, in the case of the frequency of the load voltage=30 (Hz) and the amplitude of the load voltage=0.5 (PU). In passing, 1 PU designates a relative value of the amplitude value when the rated amplitude is assumed to be one.

First of all, the power source voltage 201 is generated such that a phase of the power source voltage at the time of 0 second becomes 0 degree, and further, the load voltage 202 is generated such that a phase of the load voltage at the time of 0 second becomes 30 degrees. Then, the absolute value 203 of the interpole voltage is found, which is the absolute value of the difference value between the power source voltage 201 and the load voltage 202.

Figure 4:
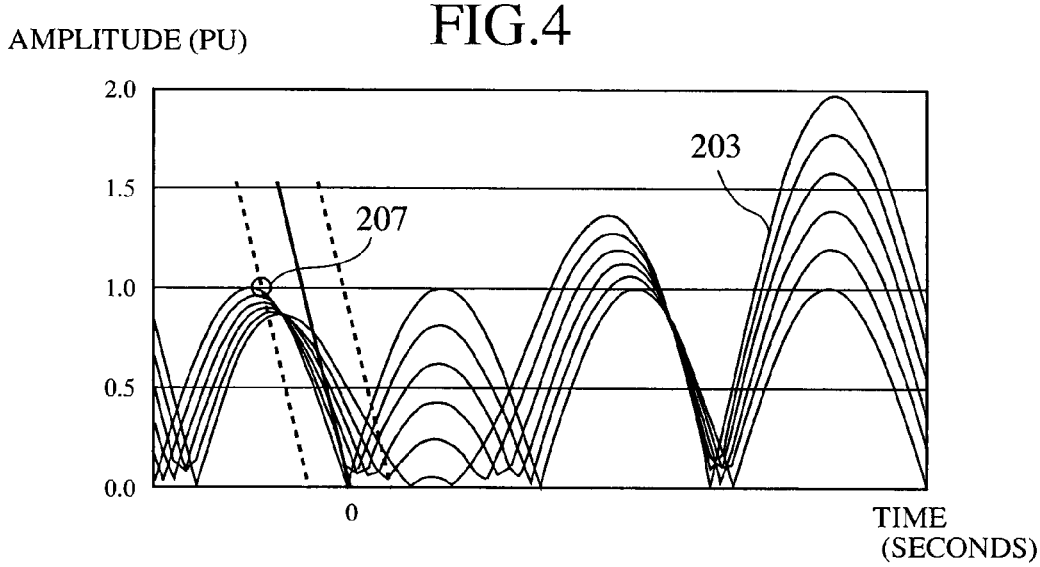
FIG. 4 is an explanatory diagram showing the input voltage of the controlled switching device when an amplitude of the load voltage is changed.

Subsequently, a withstand voltage line 204 having a slant based on the pre-arc characteristic of the breaker 6 is changed within the range of the closing time variation 205, with the time 0 second as the center, and thereby, an input voltage 206 is found, which is the maximum value of the intersection between the withstand voltage line and the absolute value 203 of the interpole voltage. Thereafter, as shown in FIG. 4, the maximum value of the input voltage 206 obtained when the amplitude of the load voltage is changed in the range of from 0 PU to 1 PU is taken as the maximum input voltage 207. FIG. 4 shows an example in which the frequency of the load voltage is 30 (Hz) and (the phase of the power source voltage, the phase of the load voltage)=(0 degree, 30 degrees), respectively. The maximum input voltage 207 thus obtained is taken as a map point.

Figure 5:
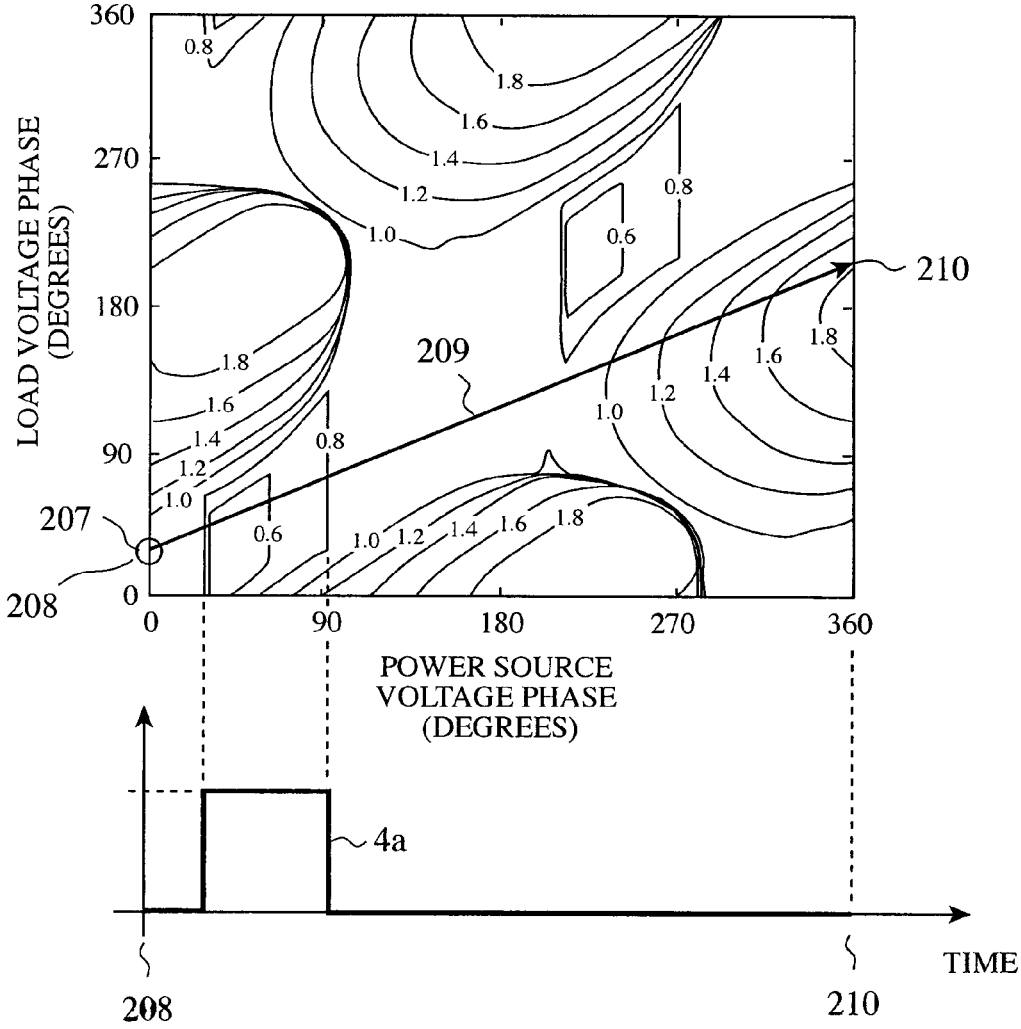
FIG. 5 is an explanatory diagram showing a target closing phase map of the controlled switching device.

In the above-described operations, changing the phase of the power source voltage within the range of 0-360 degrees and the phase of the load voltage within the range of 0-360 degrees, and calculating the map point in each of the phases generates a target closing phase map in two-dimensional form. FIG. 5 shows an example in which the target closing phase map of the frequency of the load voltage is generated, which is 30 (Hz). The 207 shown in the figure corresponds to the maximum input voltage in FIG. 4. Further, the curves of the likes of 0.6, 0.8, . . . in the figure show the amplitudes (PU) of the absolute values of the interpole voltages.

Iteration of the above-described operation with the frequency of the load voltage changed generates the target closing phase map 3*a* of each of the frequencies of the load voltage. In parenthesis, the target closing phase map 3*a* shall be generated prior to working of the controlled switching device.

Then, the target-closing-time calculating section 4 determines the target closing time strings 4*a*, from the frequency and phase 2*a* of the power source voltage and the frequency and phase 2*b* of the load voltage, which are found by the frequency-phase calculating section 2, referring to the target closing phase map 3*a*.

A method of calculating the target closing time string 4*a* will be explained referring to FIG. 5. Letting the frequency of the load voltage be 30 (Hz) and (the phase of the power source voltage, the phase of the load voltage) of the current time be (0 degree, 30 degrees), respectively, the current time corresponds to a position 208. Thereafter, the phase of the power source voltage and the phase of the load voltage will be changing in the direction indicated by an arrow on a straight line 209 with the passage of time. The slant of the straight line 209 is found from the following equation.

The slant of the straight line 209=the frequency of the load voltage/the frequency of the power source voltage.

Accordingly, a value of the maximum input voltage from the current time 208 on can be found immediately by reading out the target closing phase map 3*a* along the straight line 209. For example, an example in which the value of the time when the maximum input voltage is less than 0.8 PU is assumed to be 1 and a value of the time when the voltage is 0.8 PU or more is assumed to be 0, and the target closing time string 4*a* is generated is shown in the lower part of FIG. 5. Because it is shown that the time range when the maximum input voltage is less than 0.8, PU is one, the closing of the breaker 6 at the time when the target closing time string 4*a* is 1, the interpole voltage at the making point becomes small, which enables suppression of the overvoltage at the making time.

In this connection, it is required that the target closing time string 4*a* be calculated in a time area of the future passed away the predicted closing time 12 from the current time.

After that, upon an input of a close command 11 to the closing control section 5, the target closing time string 4*a* and a closing control signal 5*a* instructing the breaker to start its closing operation based on the predicted closing time 12 are outputted after delaying the output by a time described hereinafter.

Figure 6:
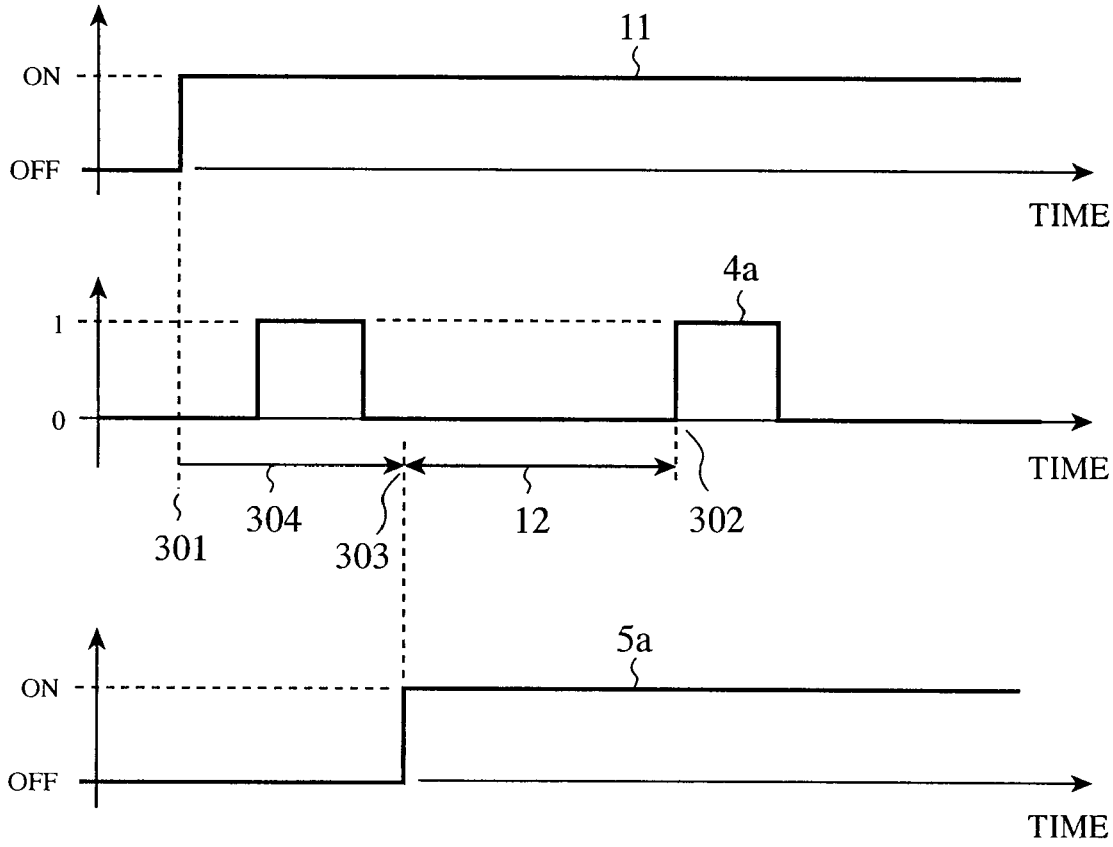
FIG. 6 is a timing chart showing an operation of the closing control section of the controlled switching device.

FIG. 6 is a timing chart showing an operation of the closing control section 5.

As shown in FIG. 6, upon input of a close command 11, a time is looked for, which is in a time area having passed away the predicted closing time 12 from the current time 301, and the target closing time string 4*a* is 1. In FIG. 6, since the time 302 is a desired time, the closing control signal 5*a* is outputted at the time 303 went back by the predicted closing time 12 from the time 302, i.e., at that point of time elapsed by the delaying time 304 from the current time 301.

Upon output of the closing control signal 5*a*, the breaker 6 is closed at the time 302 when the predicted closing time 12 has elapsed.

As mentioned above, according to the controlled switching device of the first embodiment, the device includes the voltage measuring section measuring the power source voltage and the load voltage of a power switchgear; the frequency-phase calculating section calculating the frequency and the phase of each of the power source voltage and the load voltage; the target-closing phase-map generating section previously generating a target closing phase map in consideration of the pre-arc characteristic and the variations of the mechanical action of the power switchgear, and the amplitude fluctuations of the load voltage; the target-closing time calculating section calculating a target closing time from the frequency and the phase of each of the power source voltage and the load voltage referring to the target closing phase map; and the closing control section, when a close command is inputted to the power switchgear, controlling, based on the preset predicted closing time and the target closing time string, the timing of outputting a closing control signal for instructing the power switchgear to start its closing operation. Thus, the device allows performing the making of the power switchgear at the optimum timing, which enables suppressing the overvoltage generated in time of the making of the transmission line. Further, the controlled switching device provides a simple calculation during working of the device, and enables high-speed control even with an inexpensive arithmetic unit.

Moreover, according to the controlled switching device of the first embodiment, the target closing phase map is designed to indicate the maximum value of the absolute value of the interpole voltage, corresponding to the power source voltage phase and the load voltage phase at the making point in time of the power switchgear, thus permitting determination of the optimum time in making the power switchgear by a simple calculation.

What is claimed is:

1. A controlled switching device comprising:

a voltage measuring means for measuring a power source voltage and a load voltage of a breaker;

a frequency-phase calculating means for calculating a frequency and a phase of the power source voltage and the load voltage;

a target-closing phase-map generating means for generating a target closing phase map based on pre-arc characteristics of the breaker, a mechanical action of the breaker, and amplitude fluctuations of the load voltage;

a target-closing time calculating means for calculating a target closing time string based on the frequency and the phase of the power source voltage and the load voltage, and the target closing phase map; and a closing control means for controlling, when a close command is inputted to the breaker, a timing of an output of a closing control signal for instructing the breaker to start a closing operation based on a preset predicted closing time and the target closing time string.

2. The controlled switching device according to claim 1, wherein the target-closing phase-map generating means generates the target closing phase map where the phase of the power source voltage is a first axis and the phase of the load voltage is a second axis, the is map indicates the maximum value of an absolute value of an interpole voltage for each phase of the power source voltage and the load voltage.

3. The controlled switching device according to claim 2, wherein target-closing phase-map generating means generates the target closing phase map for phases of the power source voltage and the load voltage between 0 to 360 degrees.

4. The controlled switching device according to claim 1, wherein the target-closing phase-map generating means generates the target closing phase map based on pre-arc characteristics including a voltage applied between contacts of the breaker and an absolute value of an interpole voltage at a moment which a main circuit current begins to flow.

5. The controlled switching device according to claim 1, wherein the target-closing phase-map generating means generates the target closing phase map based on pre-arc characteristics including an interpole voltage being a difference of value between the power source voltage and the load voltage.

6. The controlled switching device according to claim 1, wherein the target-closing phase-map generating means generates the target closing phase map based on a mechanical operation time lapse of the breaker.

7. A controlled switching device comprising:

a voltage measuring unit configured to measure a power source voltage and a load voltage of a breaker;

a frequency-phase calculating unit configured to calculate a frequency and a phase of the power source voltage and the load voltage;

a target-closing phase-map generating unit configured to generate a target closing phase map based on pre-arc characteristics of the breaker, a mechanical action of the breaker, and amplitude fluctuations of the load voltage;

a target-closing time calculating unit configured to calculate a target closing time string based on the frequency and the phase of the power source voltage and the load voltage, and the target closing phase map; and a closing control unit configured to control, when a close command is inputted to the breaker, a timing of an output of a closing control signal for instructing the breaker to start a closing operation based on a preset predicted closing time and the target closing time string.

8. The controlled switching device according to claim 7, wherein the target-closing phase-map generating unit is configured to generate the target closing phase map where the phase of the power source voltage is a first axis and the phase of the load voltage is a second axis, the map indicates the maximum value of the absolute value of an interpole voltage for each phase of the power source voltage and the load voltage.

9. The controlled switching device according to claim 8, wherein target-closing phase-map generating unit is configured to generate the target closing phase map for phases of the power source voltage and the load voltage between 0 to 360degrees.

10. The controlled switching device according to claim 7, wherein the target-closing phase-map generating unit is configured to generate the target closing phase map based on pre-arc characteristics including a voltage applied between contacts of the breaker and an absolute value of an interpole voltage at a moment which a main circuit current begins to flow.

11. The controlled switching device according to claim 7, wherein the target-closing phase-map generating unit is configured to generate the target closing phase map based on pre-arc characteristics including an interpole voltage being a difference of value between the power source voltage and the load voltage.

12. The controlled switching device according to claim 7, wherein the target-closing phase-map generating unit is configured to generate the target closing phase map based on a mechanical operation time lapse of the breaker.

* * * * *